US006142739A

United States Patent [19]

Harvey

[11] Patent Number: 6,142,739

[45] **Date of Patent: *Nov. 7, 2000**

[54] TURBINE ROTOR BLADES

[75] Inventor: Neil W Harvey, Derby, United Kingdom

[73] Assignee: Rolls-Royce PLC, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,206

[22] Filed: Mar. 25, 1997

[30] Foreign Application Priority Data

Apr. 12, 1996 [GB] United Kingdom ..... 9607578

[51] Int. Cl.[7] ..... B63H 1/26; F01D 5/14

[52] U.S. Cl. ..... 416/235; 416/236 A; 415/173.1; 415/173.5; 415/914

[58] Field of Search ..... 416/92, 97 R, 416/236 R, 237, 236 A, 235; 415/173.1, 173.5, 173.6, 914

[56] References Cited

U.S. PATENT DOCUMENTS

| | | | |
|---|---|---|---|
| 4,519,745 | 5/1985 | Rosman et al. | 416/92 X |
| 4,526,512 | 7/1985 | Hook | 416/97 X |
| 4,761,116 | 8/1988 | Braddy et al. | 416/92 |
| 4,893,987 | 1/1990 | Lee et al. | 416/92 |
| 4,896,122 | 1/1990 | Tahernia et al. . | |
| 5,503,527 | 4/1996 | Lee et al. | 416/97 X |
| 5,564,902 | 10/1996 | Tomita | 416/92 X |
| 5,688,107 | 11/1997 | Downs et al. | 416/228 X |

FOREIGN PATENT DOCUMENTS

| | | |
|---|---|---|
| 0 317 432 | 5/1989 | European Pat. Off. . |
| 0 593 069 A2 | 4/1994 | European Pat. Off. . |
| 0 684 364 | 11/1995 | European Pat. Off. . |
| 2 074 130 | 10/1971 | France . |
| 14 28 165 | 2/1969 | Germany . |
| 22 02 857 | 6/1973 | Germany . |
| 32 17 085 | 11/1983 | Germany . |
| 35 00 692 | 7/1986 | Germany . |
| 536 238 | 5/1941 | United Kingdom . |
| 733 918 | 7/1955 | United Kingdom . |
| 856375 | 12/1960 | United Kingdom . |
| 1282796 | 7/1972 | United Kingdom . |
| 1357713 | 6/1974 | United Kingdom . |
| 1426049 | 2/1976 | United Kingdom . |
| 2005775 | 4/1979 | United Kingdom . |
| 2 111 131 | 6/1983 | United Kingdom . |
| 2111131 | 6/1983 | United Kingdom . |
| 2155558 | 9/1985 | United Kingdom . |
| 2 201 853 | 9/1988 | United Kingdom . |
| 2279705 | 1/1995 | United Kingdom . |

*Primary Examiner*—John E. Ryznic
*Attorney, Agent, or Firm*—Oliff & Berridge, PLC

[57] ABSTRACT

An unshrouded turbine rotor blade 24 for use particularly in gas turbine engines comprising an aerofoil 30 having a leading edge 32 and a trailing edge 34. The radially outer extremity of the aerofoil 30 having a passage 42 defined by a peripheral wall 44. An aperture is formed within the wall 44 in the proximity of the trailing edge 32 of the aerofoil portion 30. The walled passage 42 is provided to capture and retain air or gas flowing over the tip of the aerofoil 30 and redirect the flow through the aperture 46 at the trailing edge of the aerofoil 30.

2 Claims, 3 Drawing Sheets

TURBINE ROTOR BLADES

BACKGROUND OF THE INVENTION

1. Field of Invention

This invention relates to turbine rotor blades and in particular to rotor blades for use in gas turbine engines.

2. Description of Related Art

The turbine of a gas turbine engine depends for its operation on the transfer of energy between the combustion gases and the turbine. The losses which prevent the turbine from being totally efficient are due at least in part to gas leakage over the turbine blade tips.

Hence the efficiency of each rotor stage in a gas turbine engine is dependent on the amount of energy transmitted into the rotor stage and this is limited particularly in unshrouded blades by any leakage flow of working fluid ie. air or gas across the tips of the blades of the rotors.

In turbines with unshrouded turbine rotor blades a portion of the working fluid flowing through the turbine tends to migrate from the concave pressure surface to the convex suction surface of the aerofoil portion of the blade through the gap between the tip of the aerofoil and the stationary shroud or casing. This leakage occurs because of a pressure difference which exists between the pressure and suction sides of the aerofoil. The leakage flow also causes flow disturbances to be set up over a large proportion of the height of the aerofoil which leads to losses in efficiency of the turbine.

By controlling the leakage flow of air or gas across the tips of the blades it is possible to increase the efficiency of each rotor stage.

There is disclosed in GB 2155558A an unshrouded rotor blade which has a recess at its radially outer extremity. The recess is defined by a peripheral wall and a number of transverse walls extending across the recess, thereby dividing the aerofoil into a number of chambers. These walls form a labyrinth seal and trapped vortices are set up in each of these chambers. The trapped vortices aim to reduce the leakage flow between the tip of the blade and the shroud or casing.

The above arrangement traps the leakage flow within the recesses thereby reducing leakage flow across the tip of the blade. However the kinetic energy of this flow is still lost since it remains trapped within the chambers. This flow still forms a vortex in the main passage, albeit of reduced strength, which generates extra loss. In addition the prior art arrangement suffers from the disadvantage that most of the over tip leakage flow is over the rear part of the aerofoil where typically it is too thin to form within a cavity.

SUMMARY OF THE INVENTION

It is an aim of the present invention to provide a turbine blade which alleviates the disadvantages inherent in overtip leakage flow but also employs the flow itself to give improved efficiency.

Accordingly the present invention provides an unshrouded rotor blade including an aerofoil portion, said aerofoil portion having a leading edge and a trailing edge and the radially outer extremity of said aerofoil section having a passage defined by at least one wall wherein an aperture is formed within said wall and in the proximity of the trailing edge of said aerofoil portion.

Also according to the invention there is provided a method of controlling the flow of air or gas over the radial extremity of an unshrouded turbine rotor blade comprising the step of capturing said flow within a walled passage provided at the radial extremity of said aerofoil portion and redirecting it to exhaust through an aperture in said walled passage at the trailing edge of said aerofoil portion.

The invention provides the advantages that the 'over tip leakage' flow, that is the flow of hot air or gas which flows over the tip of a shroudless blade, is directed into a passage formed within the tip of the aerofoil section of the blade thereby alleviating the flow disturbances set up by this 'leakage flow'. Also the flow is redirected by the passage to flow from the leading edge of the aerofoil to the trailing edge through the passage and exhaust through an exit within the wall at the trailing edge. Since the flow is redirected in this way, work which would have otherwise been lost by the flow is recovered.

In addition the gutter may also contain and therefore redirect the existing classical secondary flow 'passage' vortex formed from boundary layer flow which rolls up on the casing. If the gutter and the exit aperture are of a sufficient size this 'passage' vortex will enter the gutter over its suction side wall and join the overtip leakage vortex, exiting through the exit aperture. This passage vortex is greatly reduced in the gutter where it is inhibited from growing freely, thus flow conditions downstream of the gutter are improved since the exiting vortex is much smaller than it would otherwise have been external of the gutter. Preferably the wall portion is in the form of a gutter placed over the tip of the aerofoil section of the rotor blade.

Advantageously the gutter comprises a wider cross section than the top of the aerofoil tip at the trailing edge. Also preferably the gutter is wider than the cross section of the aerofoil portion. This ensures that at least most of the flow contained in the gutter, that is the flow that forms between the casing and the pressure side of the gutter and/or the existing secondary flow vortex (which passes between the casing and the pressure side of the gutter) passes through the gutter and the exit aperture of the gutter.

In an embodiment of the invention the rotor blade is in particular a fan blade for a gas turbine engine.

BRIEF DESCRIPTION OF THE DRAWINGS

The invention will be described more fully with reference to the accompanying drawings in which.

DETAILED DESCRIPTION OF PREFERRED EMBODIMENTS

Figure 1:
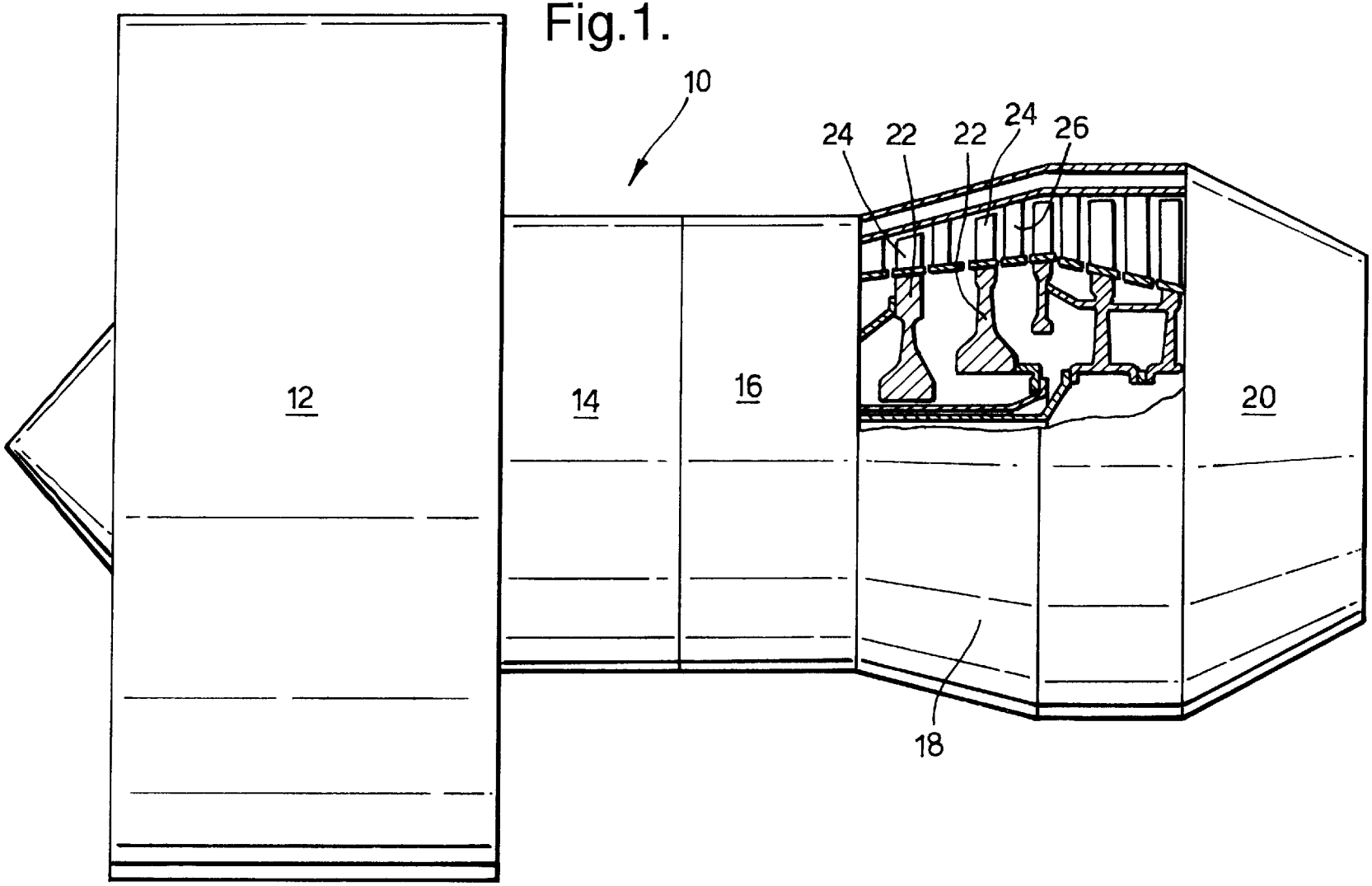
FIG. 1 is diagrammatic view of a gas turbine engine which is partially cut away to show the turbine section.

A gas turbine engine 10 as shown in FIG. 1 comprises in flow series a fan 12, a compressor 14, a combustion system 16, a turbine section 18, and a nozzle 20. The turbine section 18 comprises a number of rotors 22 and stator vanes 26, each rotor 22 has a number of turbine blades 24 which extend radially therefrom.

Figure 2:
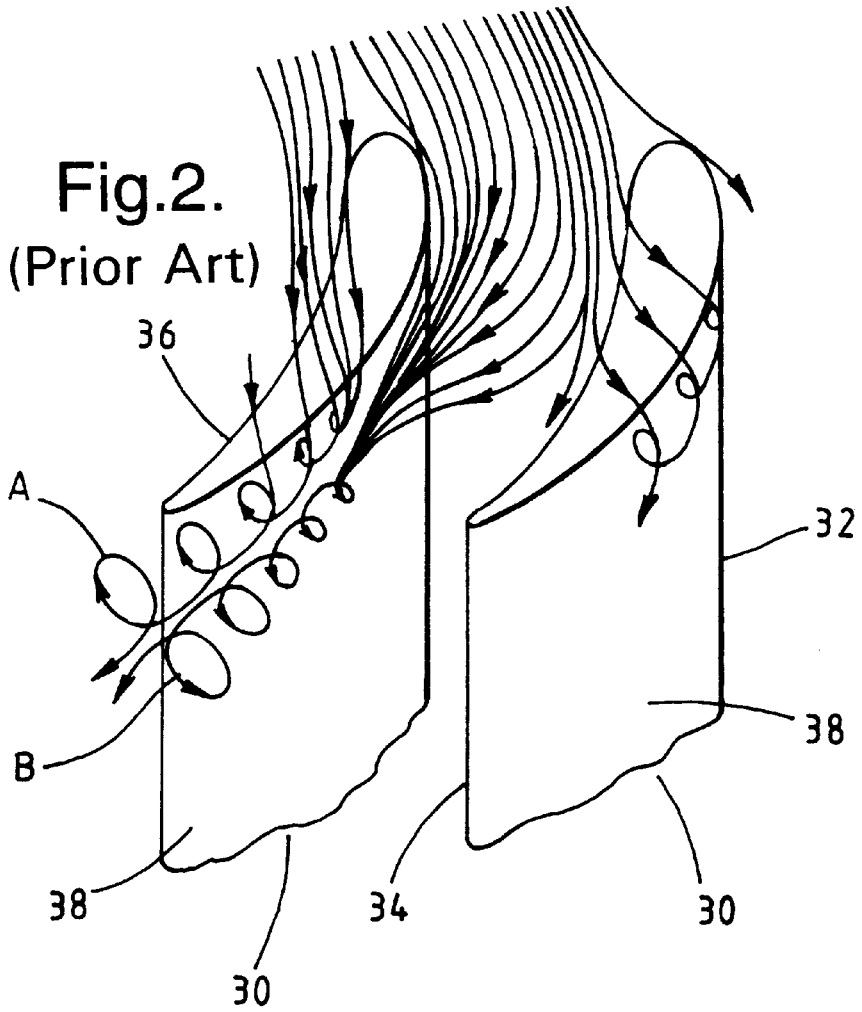
Fig.2. (Prior Art)
FIG. 2 is an illustration of overtip leakage flow over prior art turbine rotor blade.
Figure 3:
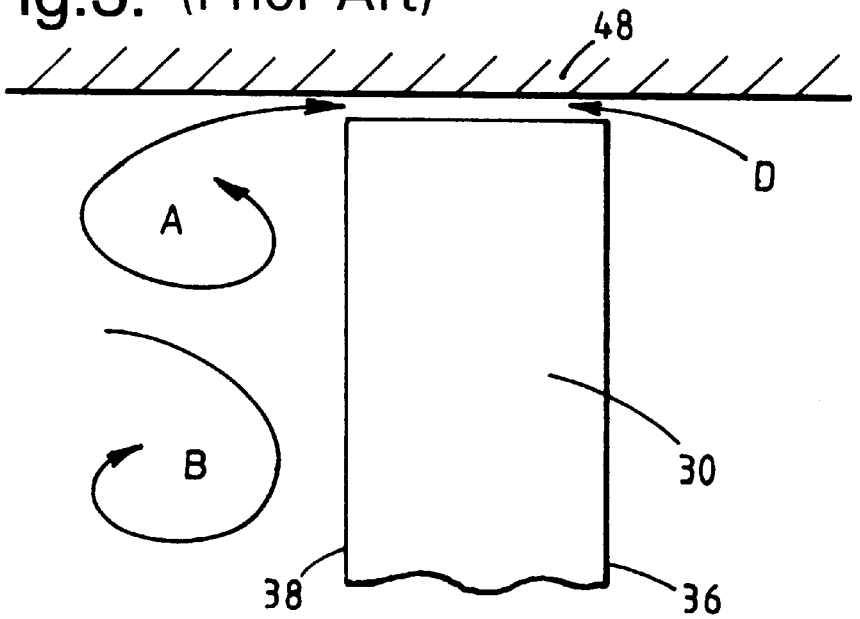
Fig.3. (Prior Art)
FIG. 3 is another illustration of overtip leakage flow over a prior art turbine rotor blade.

FIGS. 2 and 3 illustrate the leakage of hot air or gas over the tip of the aerofoil portions 30. The aerofoil 30 has a leading edge 32 and a trailing edge 34. In turbines with unshrouded turbine blades, as illustrated in FIG. 2 a portion of the flow of gas migrates from the concave pressure surface 36 to the convex suction surface 38 over the tip of the aerofoil portion of the blade 24. This leakage flow exists because of a pressure difference between the pressure and suction surfaces 36,38. The flow over the tip of the aerofoil forms a vortex indicated by arrow A.

Figure 4:
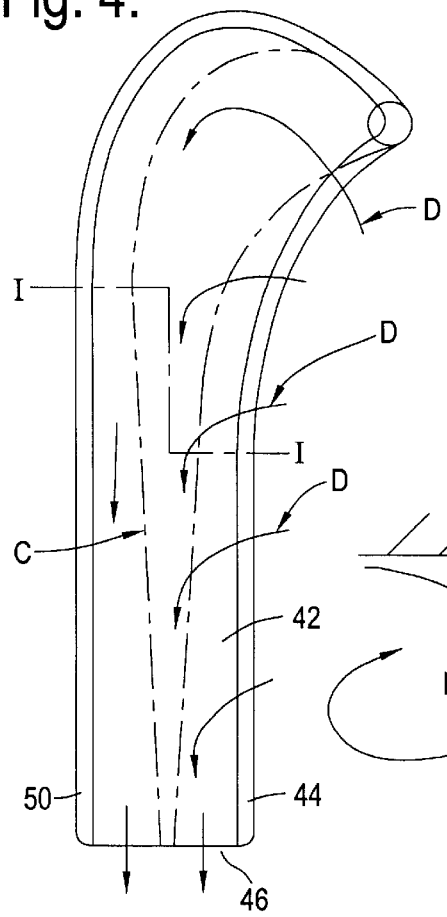
FIG. 4 is an top view of the aerofoil portion of a rotor blade showing the walled portion.
Figure 5:
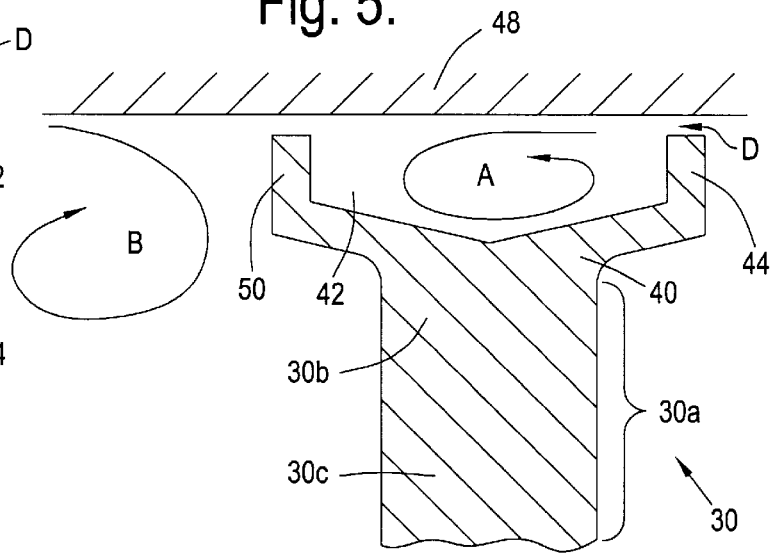
FIG. 5 is a section through the tip of an aerofoil portion indicated by I of FIG. 4 incorporating the gutter.
Figure 6:
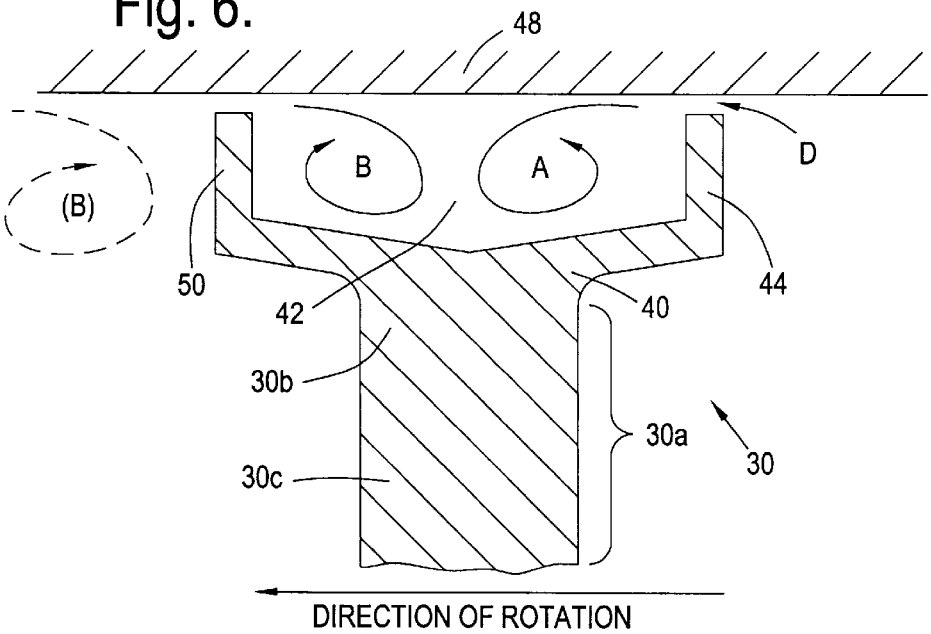
FIG. 6 is another section through the tip of the aerofoil section of FIG. 4 indicated by I.

FIGS. 4 to 6 show the tip of an aerofoil section incorporating the gutter. In FIG. 4 the aerofoil section is indicated by line C. A gutter 40 is positioned over the tip of the aerofoil. It is envisaged that the gutter 40 may comprise two walls unconnected at the trailing edge and the leading edge (not shown). The gutter 40 provides a passage 42 defined by a peripheral wall 44. An exit 46 is provided in the wall 44 at the trailing edge 34 of the aerofoil. The direction of leakage flow 28 across the tip of the aerofoil is shown by arrow D. The turbine casing 48 is in close proximity to the gutter 40 and overtip leakage flow is directed into the gutter in the direction of arrow D. The gutter 40 is in close proximity to the turbine casing 48 and the flow is directed between the casing and into the gutter 40 in the direction of arrow C and to the exit aperture 46. The exit aperture is at its widest at the 'trailing edge' of the gutter.

In the embodiments shown in FIGS. 5 and 6, the width of the gutter 40 is greater than the width of a tip portion 30*b* of an aerofoil portion 30*a* of the aerofoil 30. The width of the gutter 40 is also greater than the width of a crosssection through a main body portion 30*c* of the aerofoil portion 30*a*.

In operation air enters the gas turbine engine 10 and flows through and is compressed by the fan 12 and the compressor 14. Fuel is burnt with the compressed air in the combustion system 16, and hot gases produced by combustion of the fuel and the air flow through the turbine section 18 and the nozzle 20 to atmosphere. The hot gases drive the turbines which in turn drive the fan 12 and compressors 14 via shafts.

The turbine section 18 comprises stator vanes 26 and rotor blades 24 arranged alternately, each stator vane 26 directs the hot gases onto the aerofoil 30 of the rotor blade 24 at an optimum angle. Each rotor blade 24 takes kinetic energy from the hot gases as they flow through the turbine section 18 in order to drive the fan 12 and the compressor 14.

The efficiency with which the rotor blades 24 take kinetic energy from hot gases determines the efficiency of the turbine and this is partially dependent upon the leakage flow of hot gases between the tip of the aerofoil 30 and the circumferentially extending shroud 48.

The leakage flow across the tip of the aerofoil 30 is trapped within the passage formed by the gutter 40 positioned over the aerofoil tip. In the embodiment as indicated in FIG. 5, this trapped flow forms a vortex A within the gutter. The flow is then redirected along the passage subsequently exhausting from the gutter trailing edge through the exit aperture 46. In this embodiment the exit aperture 46 comprises an area or width large enough to allow all the flow that occurs between the casing 48 and the pressure side wall 44 of the gutter, to exit downstream. Since the area of the exit aperture 46 is of a size sufficient to allow all the tip leakage flow (D) pass through it (as a vortex A), this reduces the risk of some tip leakage flow continuing to exit over the suction side wall 50 of the gutter 40 into the main passage, as is the case for a rotor with a plain rotor tip.

In another embodiment as illustrated in FIG. 6, the overtip leakage flow D again forms a vortex A within the gutter 40, However in this embodiment, the gutter is large enough such that the passage vortex B also forms in the gutter itself. The passage vortex B is formed from the casing boundary layer flow which, in this embodiment, passes between the casing 48 and the pressure side wall 50 of the gutter 40. The area of the exit aperture is of a width sufficient to allow both vortex flows A and B to pass through it. Thus, again, in this embodiment the exit aperture is of a size sufficient to allow both flows A and B to pass through it.

The target velocity distribution of the flow in close proximity to the gutter 40, is for the flow to accelerate continuously to the trailing edge on both the pressure and suction surface sides and thus obtain the peak Mach number (minimum static pressure) at the trailing edge. The aim is for the static pressure in the gutter 40 to match that on the external suction surface 38 of the aerofoil. This will help prevent flow trapped within the gutter from flowing over the sides of the gutter.

A vortex may form within the passage formed by the gutter 40. However, the vortex may be weaker than that formed if the overtip leakage flow had been allowed to penetrate the main flow. Interaction of the vortex formed within the gutter 40 will be prevented until the flow is exhausted from the gutter trailing edge.

The flow D along the gutter 40 is established near the leading edge 32 and flows to the trailing edge 34. The flow already established in the gutter may act to reduce flow over the peripheral wall 44, nearer to the trailing edge 34 ie. act as an ever increasing cross-flow to later leakage flow. Thus the gutter 40 is as effective near the trailing edge as it is further upstream.

I claim:

1. An unshrouded rotor blade including an aerofoil portion having a leading edge and a trailing edge, a radially outer extremity of the aerofoil portion having a passage defined by peripheral walls of a gutter, and a width of the gutter being greater than a width of a tip of the aerofoil portion.

2. An unshrouded rotor blade including an aerofoil portion having a leading edge and a trailing edge, a radially outer extremity of the aerofoil portion having a passage defined by peripheral walls of a gutter, and a width of the gutter being greater than a width of a crosssection of the aerofoil portion.

* * * * *